US011662149B2

(12) United States Patent
Saviers et al.

(10) Patent No.: US 11,662,149 B2
(45) Date of Patent: May 30, 2023

(54) LAYERED DIFFUSER CHANNEL HEAT EXCHANGER

(71) Applicant: B/E AEROSPACE, INC., Winston Salem, NC (US)

(72) Inventors: Kimberly Saviers, Glastonbury, CT (US); Matthew Pearson, Hartford, CT (US)

(73) Assignee: B/E Aerospace, Inc., Winston Salem, NC (US)

( * ) Notice: Subject to any disclaimer, the term of this patent is extended or adjusted under 35 U.S.C. 154(b) by 0 days.

(21) Appl. No.: 17/467,044

(22) Filed: Sep. 3, 2021

(65) Prior Publication Data

US 2023/0076321 A1 Mar. 9, 2023

(51) Int. Cl.

| | |
|---|---|
| ***F24H 3/02*** | (2022.01) |
| ***F28D 1/02*** | (2006.01) |
| ***F28D 1/04*** | (2006.01) |
| ***F28F 1/12*** | (2006.01) |

(52) U.S. Cl.

CPC ..... *F28D 1/024* (2013.01); *F28D 1/0443* (2013.01); *F28F 1/12* (2013.01); *F28F 2215/04* (2013.01); *F28F 2255/00* (2013.01)

(58) Field of Classification Search

CPC ..... F28D 1/024; F28D 1/0443; F28F 1/12; F28F 2215/04; F28F 2255/00

USPC ..... 165/121

See application file for complete search history.

(56) References Cited

U.S. PATENT DOCUMENTS

| | | | |
|---|---|---|---|
| 3,424,240 | A | 1/1969 | Stein et al. |
| 6,945,315 | B1 | 9/2005 | Gektin et al. |
| 6,945,318 | B2 | 9/2005 | Ma et al. |
| 10,856,433 | B2 | 12/2020 | Zhou |
| 2002/0000310 | A1 | 1/2002 | Cheadle |
| 2011/0232885 | A1 | 9/2011 | Kaslusky et al. |
| 2015/0330718 | A1 | 11/2015 | St. Rock et al. |

FOREIGN PATENT DOCUMENTS

| | | | |
|---|---|---|---|
| DE | 19547440 | | 6/1996 |
| EP | 1288604 | | 3/2003 |
| GB | 546172 | | 7/1942 |
| KR | 20150058402 | * | 5/2015 |
| WO | 9930099 | | 6/1999 |

OTHER PUBLICATIONS

European Patent Office, European Search Report dated Jan. 9, 2023 in Application No. 22193908.5.

* cited by examiner

*Primary Examiner* — Davis D Hwu

(74) *Attorney, Agent, or Firm* — Snell & Wilmer L.L.P.

(57) ABSTRACT

A layered diffuser-channel heat exchanger may comprise a plurality of fluid channel layers and a plurality of diffuser fin layers interleaved with the plurality of fluid channel layers. Each fluid channel layer of the plurality of fluid channel layers may have a first surface, a second surface opposite the first surface, and a fluid channel located between the first surface and the second surface.

18 Claims, 9 Drawing Sheets

LAYERED DIFFUSER CHANNEL HEAT EXCHANGER

FIELD

The present disclosure relates to heat exchangers, and, more particularly, to layered diffuser-channel heat exchanger assemblies and methods of forming the same.

BACKGROUND

Many aerospace applications, such as aircraft cabin cooling systems and/or aircraft refrigeration systems, employ heat exchangers to remove heat from an airflow. The airflow may flow through one or more heat exchanger channels during the heat exchange process. Fluid pressure drop through the channels of the heat exchanger should be carefully managed to minimize pressure losses. Further, many heat exchanger systems include an external fan to drive airflow and increase the heat transfer coefficient at the interface between air and the walls of the heat exchanger channels. External fans tend to increase the power demands and overall footprint of the heat exchanger.

SUMMARY

A layered diffuser-channel heat exchanger is disclosed herein. In accordance with various embodiments, the layered diffuser-channel heat exchanger may comprise a plurality of fluid channel layers and a plurality of diffuser fin layers interleaved with the plurality of fluid channel layers. Each fluid channel layer of the plurality of fluid channel layers may have a first surface, a second surface opposite the first surface, and a fluid channel located between the first surface and the second surface.

In various embodiments, a blower may be located in a central cavity surrounded by the plurality of fluid channel layers and the plurality of diffuser fin layers. In various embodiments, the blower may include a first stage of blades configured to rotate about an axis, a second stage of the blades configured to rotate about the axis, and a first stage of stationary vanes located axially between the first stage of blades and the second stage of the blades. The first stage of stationary vanes is configured to direct airflow between the first surface of a first fluid channel layer and the second surface of a second fluid channel layer. The plurality of fluid channels layer includes the first fluid channel layer and the second fluid channel layer. The first fluid channel layer is axially adjacent to the second fluid channel layer.

In various embodiments, the blower may further include a third stage of the blades configured to rotate about the axis, and a second stage of stationary vanes located axially between the second stage of blades and the third stage of the blades. The second stage of stationary vanes is configured to direct airflow between the first surface of the second fluid channel layer and the second surface of a third fluid channel layer. The plurality of fluid channels layer includes the third fluid channel layer.

In various embodiments, a motor may be located axially between the third stage of blades and the second stage of blades. In various embodiments, the first surface of a first fluid channel layer of the plurality of fluid channel layers is oriented at a non-perpendicular angle relative to an axis of rotation of the blower.

In various embodiments, a first diffuser fin layer of the plurality of diffuser fin layers includes a plurality of diffuser fins integrally formed with the first surface of a first fluid channel layer and the second surface of a second fluid channel layer. The plurality of fluid channel layers includes the first fluid channel layer and the second fluid channel layer.

In various embodiments, the plurality of diffuser fins includes a first group of diffuser fins having a first radial length, a second group of diffuser fins having a second radial length greater than the first radial length, and a third group of diffuser fins have a third radial length greater the second radial length. Each of the first group of diffuser fins, the second group of diffuser fins, and the third group of diffuser fins extends radially inward from an outer circumference of the first fluid channel layer. The third group may extend from the outer circumference of the first fluid channel layer to an inner circumference of the first fluid channel layer.

A method of making a layered diffuser-channel heat exchanger is also disclosed herein. In accordance with various embodiments, the method may comprise forming a first fluid channel layer having a first fluid channel located between a first surface and a second surface of the first fluid channel layer, forming a plurality of first diffuser fins extending from the first surface of the first fluid channel layer, and forming a second fluid channel layer over the plurality of first diffuser fins. The second fluid channel layer may have a second fluid channel located between a topside surface and an underside surface of the second fluid channel layer, the underside surface being integrally formed with the plurality of first diffuser fins. The method may further comprise forming a plurality of second diffuser fins extending from the topside surface of the second fluid channel layer.

In various embodiments, the first fluid channel layer, the plurality of first diffuser fins, the second fluid channel layer, and the plurality of second diffuser fins are formed using additive manufacturing. In various embodiments, the method may further comprise locating a blower in a central cavity surrounded by the first fluid channel layer, the plurality of first diffuser fins, the second fluid channel layer, and plurality of second diffuser fins.

In various embodiments, the method may further comprise locating a first stage of stationary vanes axially between a first stage of blades of the blower and a second stage of blades of the blower. The first stage of stationary vanes may be configured to direct airflow between the first surface of a first fluid channel layer and the underside surface of a second fluid channel layer.

In various embodiments, the method may further comprise orienting the first surface of the first fluid channel at a first non-perpendicular angle relative to an axis of rotation of first stage of blades of the blower, and orienting the topside surface of the second fluid channel at a second non-perpendicular angle relative to the axis of rotation of first stage of blades of the blower.

In various embodiments, the underside surface of the second fluid channel layer is integrally formed with the plurality of first diffuser fins.

In various embodiments, forming the plurality of first diffuser fins comprises forming a first group of the first diffuser fins having a first radial length, forming a second group of the first diffuser fins having a second radial length greater than the first radial length, and forming a third group of diffuser fins have a third radial length greater the second radial length. Each of the first group of first diffuser fins, the second group of first diffuser fins, and the third group of first diffuser fins extends radially inward from an outer circumference of the first fluid channel layer.

In various embodiments, the method further comprises locating a blower in a central cavity surrounded by the first fluid channel layer, the plurality of first diffuser fins, and the second fluid channel layer. The blower comprises a motor configured to drive rotation of a first stage of blades and a second stage of blades. The motor is located axially between the first stage of blades and the second stage of blades.

In accordance with various embodiments, a layered diffuser-channel heat exchanger may comprise a first fluid channel layer having a first fluid channel located between a first surface and a second surface of the first fluid channel layer, a plurality of first diffuser fins extending from the first surface of the first fluid channel layer, and a plurality of second diffuser fins extending from the second surface of the first fluid channel layer. The plurality of first diffuser fins is integrally formed with the first surface. The plurality of second diffuser fins is integrally formed with the second surface.

In various embodiments, the first fluid channel may be formed in a circumferential serpentine pattern. In various embodiments, a fluid source may be coupled to an inlet of first fluid channel. The circumferential serpentine pattern may cause the fluid from the first fluid source to flow circumferentially and radially inward across the first fluid channel layer.

In various embodiments, a second fluid channel layer may be integrally formed with the plurality of first diffuser fins.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1A:
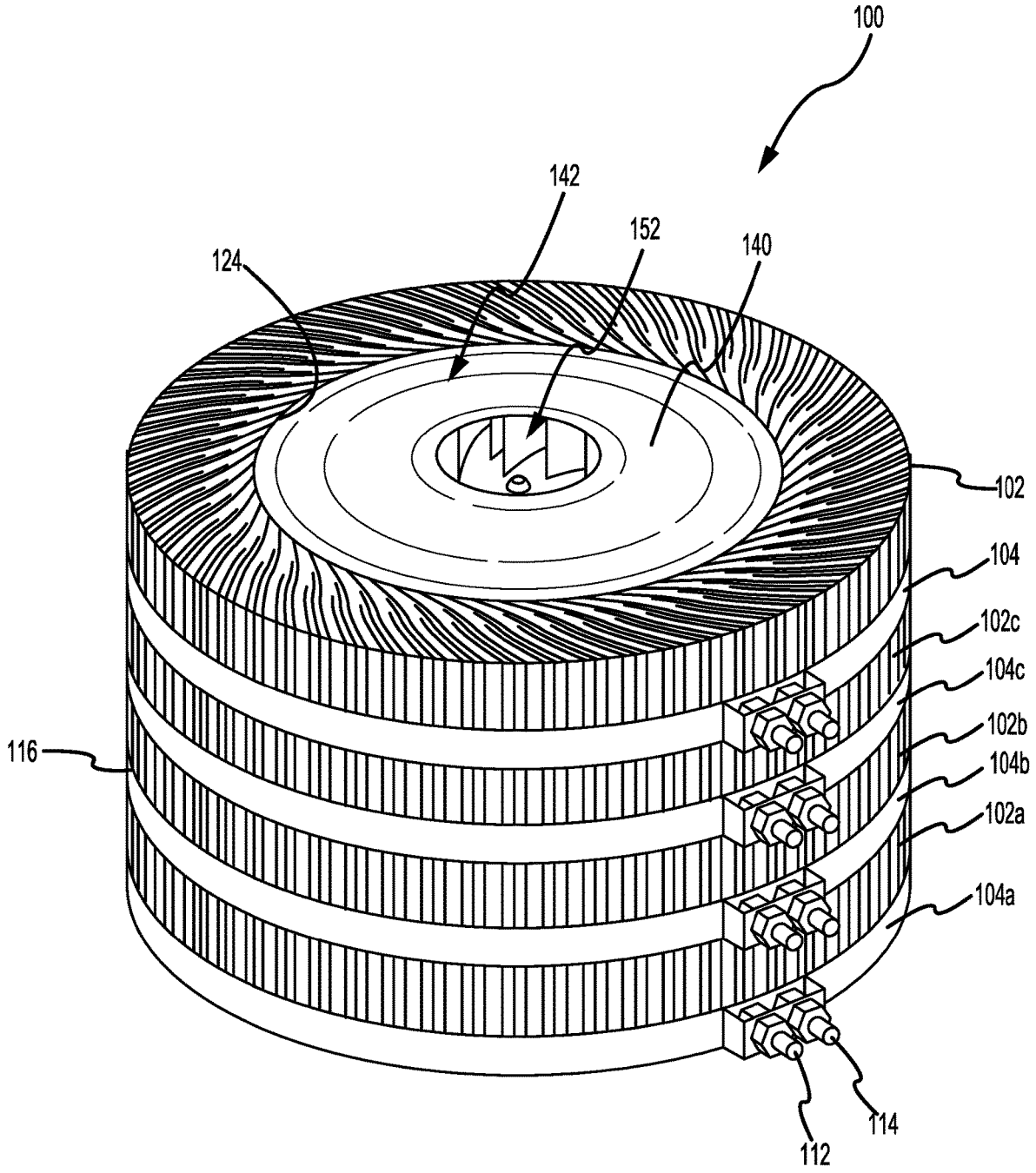
FIG. 1A illustrates a perspective view of a layered diffuser-channel heat exchanger, in accordance with various embodiments.

The detailed description of various embodiments herein makes reference to the accompanying drawings, which show various embodiments by way of illustration. While these various embodiments are described in sufficient detail to enable those skilled in the art to practice the inventions, it should be understood that other embodiments may be realized and that logical, mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Surface shading and/or cross-hatching lines may be used throughout the figures to denote different parts, but not necessarily to denote the same or different materials. Throughout the present disclosure, like reference numbers denote like elements. Accordingly, elements with like element numbering may be shown in the figures, but may not necessarily be repeated herein for the sake of clarity.

As used herein, the term "additive manufacturing" encompasses any method or process whereby a three-dimensional object is produced by creation of a substrate or material, such as by addition of successive layers of a material to an object to produce a manufactured product that has an increased mass or bulk at the end of the additive manufacturing process as compared to the beginning of the process. In contrast, traditional (i.e., non-additive) manufacturing by machining or tooling typically relies on material removal or subtractive processes, such as cutting, machining, extruding, lathing, drilling, grinding, stamping, and/or the like, to produce a final manufactured object that has a decreased mass or bulk relative to the starting workpiece. Other traditional, non-additive manufacturing methods include forging or casting, such as investment casting, which utilizes the steps of creating a form, making a mold of the form, and casting or forging a material (such as metal) using the mold. As used herein, the term "additive manufacturing" should not be construed to encompass a joining of previously formed objects.

A variety of additive manufacturing technologies are commercially available. Such technologies include, for example, fused deposition modeling, polyjet 3D printing, electron beam freeform fabrication, direct metal laser sintering, electron-beam melting, selective laser melting, selective heat sintering, selective laser sintering, stereolithography, multiphoton photopolymerization, and digital light processing. These technologies may use a variety of materials as substrates for an additive manufacturing process, including various plastics and polymers, metals and metal alloys, ceramic materials, metal clays, organic materials, and the like. Any method of additive manufacturing and associated compatible materials, whether presently available or yet to be developed, are intended to be included within the scope of the present disclosure.

Figure 1B:
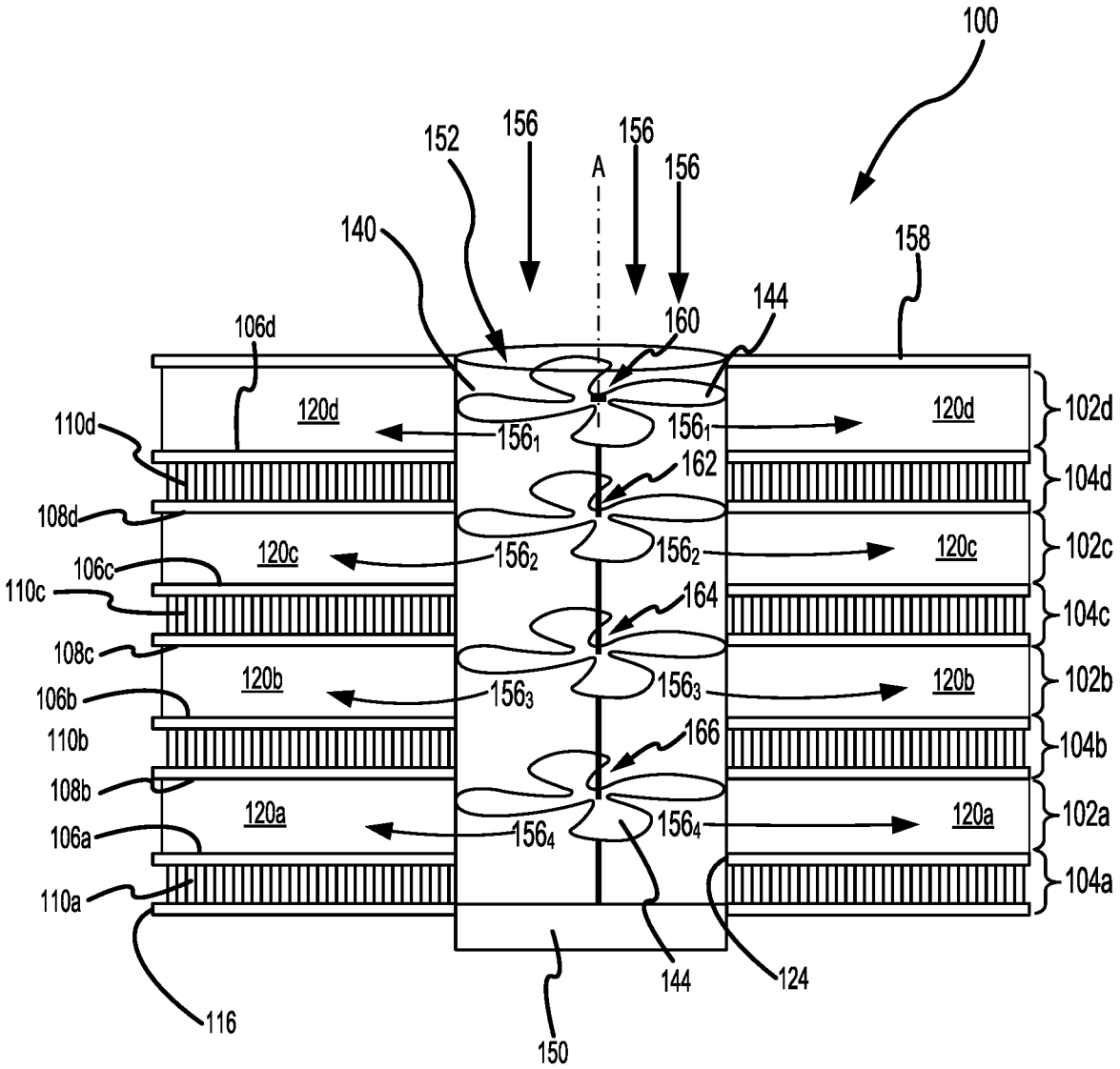
FIG. 1B illustrates a cross-section view of the layered diffuser-channel heat exchanger of FIG. 1A, taken along the line 1B-1B in FIG. 1A, in accordance with various embodiments.

Referring to FIGS. 1A and 1B, a layered diffuser-channel heat exchanger 100 is illustrated. In accordance with various embodiments, layered diffuser-channel heat exchanger 100 includes alternating diffuser fins layers 102 and fluid channel layers 104. For example, a first fluid channel layer 104*a* forms a base, or bottom, layer of layered diffuser-channel heat exchanger 100. A first diffuser fins layer 102*a* is formed over first fluid channel layer 104*a*. A second fluid channel layer 104*b* is formed over the first diffuser fins layer 102*a*. A second diffuser fins layer 102*b* is formed over the second fluid channel layer 104*b*. A third fluid channel layer 104*c* is formed over the second diffuser fins layer 102*b*. A third diffuser fins layer 102*c* is formed over the third fluid channel layer 104*c*. A fourth fluid channel layer 104*d* is formed over the third diffuser fins layer 102*c*. A fourth diffuser fins layer 102*d* is formed over the fourth fluid channel layer 104*d*, and so on. While layered diffuser-channel heat exchanger 100 is illustrated as having four (4) diffuser fins layers 102 and four (4) fluid channel layers 104, it is contemplated and understood that layered diffuser-channel heat exchanger 100 may include any number of diffuser fins layers 102 and fluid channel layers 104.

Each fluid channel layer 104 has a topside (or first) surface 106 and an underside (or second) surface 108. Underside surface 108 is opposite (i.e., oriented away) from the topside surface 106. One or more fluid channels 110 be located between the topside surface 106 and the underside surface 108 of each fluid channel layers 104. Stated differently, each fluid channel layer 104 defines fluid channel(s) 110. Fluid channels 110 may include a fluid inlet 112 and a fluid outlet 114. In various embodiments, fluid inlet 112 and fluid outlet 114 are located at an outer circumference, or outer perimeter, 116 of the fluid channel layer 104.

Figure 2A:
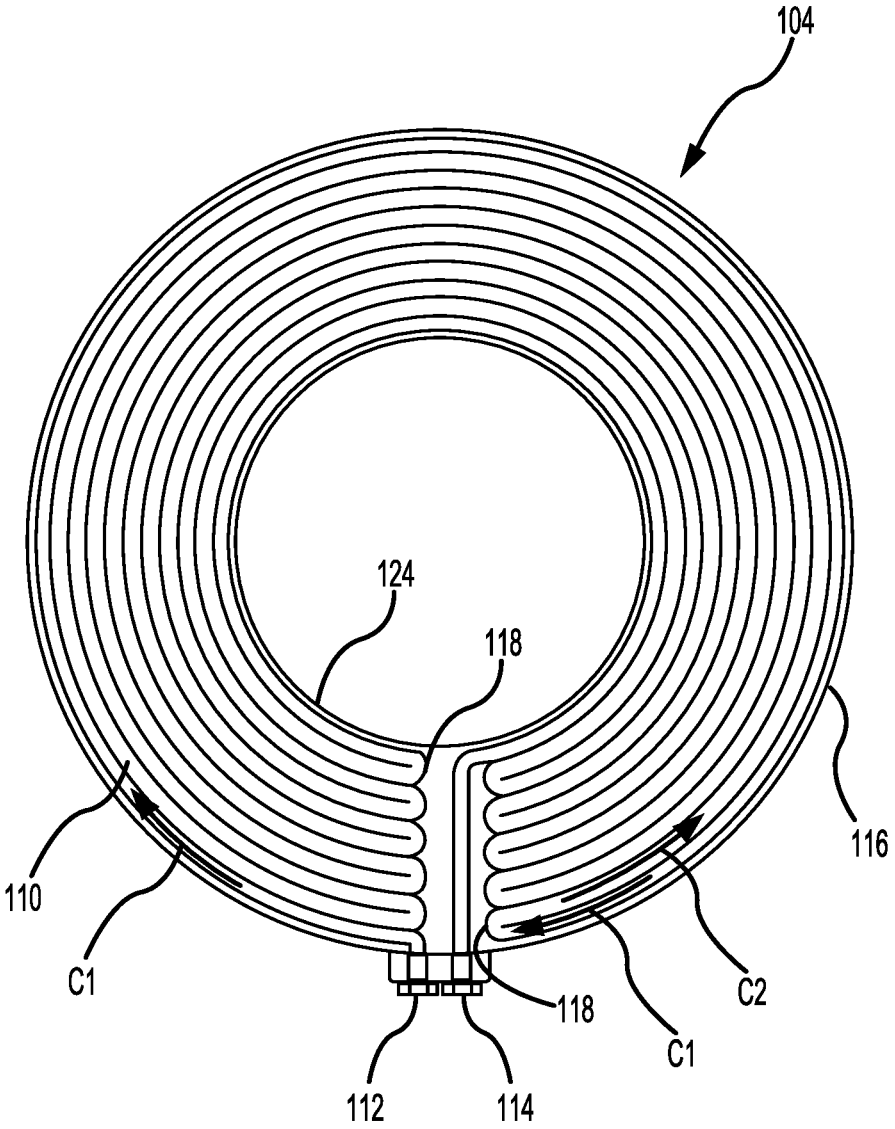
FIGS. 2A and 2B illustrate an exemplary cooling channel pattern for a layered diffuser-channel heat exchanger, in accordance with various embodiments.
Figure 2B:
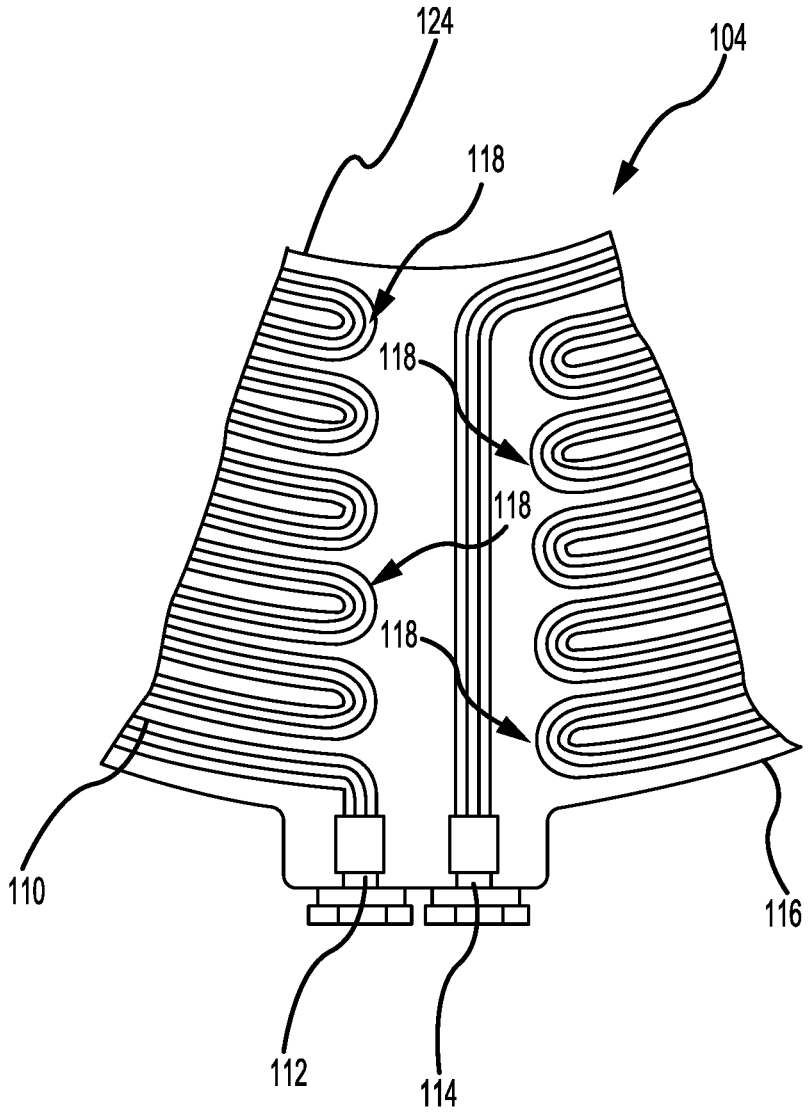

With reference to FIGS. 2A and 2B, in various embodiments, fluid channels 110 may be formed in a circumferential serpentine pattern. In various embodiments, the fluid inlet 112 is coupled to the radially outward end of the serpentine pattern, and the fluid outlet 114 is coupled to the radially inward end of the serpentine pattern. In this regard, fluid flows radially inward as it flows circumferentially through serpentine pattern. In accordance with various embodiments, fluid from a fluid source may flow into fluid channel 110 via fluid inlet 112. The fluid then begins flowing in a first circumferential direction C1 through the fluid channel layer 104. Fluid channels 110 may include one or more turns 118 configured to turn the fluid flow direction approximately 180°, such that at a turn 118 the fluid goes from flowing in the first circumferential direction C1 to flowing in a second, opposite circumferential direction C2. As the fluid flows toward fluid outlet 114, it may travel from proximate outer circumference 116 to proximate an inner circumference, or inner perimeter, 124 of the fluid channel layer 104. Flowing fluid radially inward tends to locate the downstream portions of fluid channels 110 proximate the hotter areas of the of diffuser fins layer 102, which may improve heat transfer capacity and/or thermal efficiency of layered diffuser-channel heat exchanger 100. While fluid channel layer 104 is illustrated with fluid channel(s) 110 formed in a circumferential serpentine pattern, it is contemplated and understood that fluid channel layer 104 may include fluid channels 110 formed in other suitable geometries.

Returning to FIGS. 1A and 1B, in accordance with various embodiments, each diffuser fins layer 102 includes a plurality of diffuser fins 120 extend between the surfaces of the adjacent fluid channel layers 104. In various embodiments, the diffuser fins 120 may be integrally formed with the surfaces of the adjacent fluid channel layers 104. For example, the diffuser fins 120*a* of first diffuser fins layer 102*a* are integrally formed with a topside surface 106*a* of first fluid channel layer 104*a* and an underside surface 108*b* of second fluid channel layer 104*b*. The diffuser fins 120*b* of second diffuser fins layer 102*b* are integrally formed with topside surface 106*a* of second fluid channel layer 104*b* and the underside surface 108*c* of third fluid channel layer 104*c*. Integrally forming diffuser fins layers 102 and fluid channel layers 104 tends prevent fluid from flowing between the surfaced of fluid channel layers 104 and the tips of diffuser fins 120.

In various embodiments, diffuser fins layers 102 and fluid channel layers 104 may be formed using additive manufacturing. Additively manufacturing diffuser fins layers 102 and fluid channel layers 104 tends to allow for diffuser fin and fluid channel geometries that could not be produced through conventional manufacturing. In various embodiments, the entire layered diffuser-channel heat exchanger 100 may be printed in one additive manufacturing operation (e.g., diffuser fins layer 102 and fluid channel layer 104 is printed on the previously printed layer). In various embodiment, each pair of diffuser fins layer 102 and fluid channel layer 104 may be formed individually using additive manufacturing or a non-additive manufacturing technique (depending on the desired fluid channel/diffuser fins shape/patter) and may then be bonded together, for example, via brazing. For example, first fluid channel layer 104*a* and first diffuser fins layer 102*a* may be formed in a first forming step/operation. Second fluid channel layer 104*b* and second diffuser fins layer 102*b* may be formed separately from first fluid channel layer 104*a* and first diffuser fins layer 102*a* (e.g., in a second forming step/operation). Then first diffuser fins layer 102*a* may be bonded to underside surface 108*b* of second fluid channel layer 104*b*.

Figure 3:
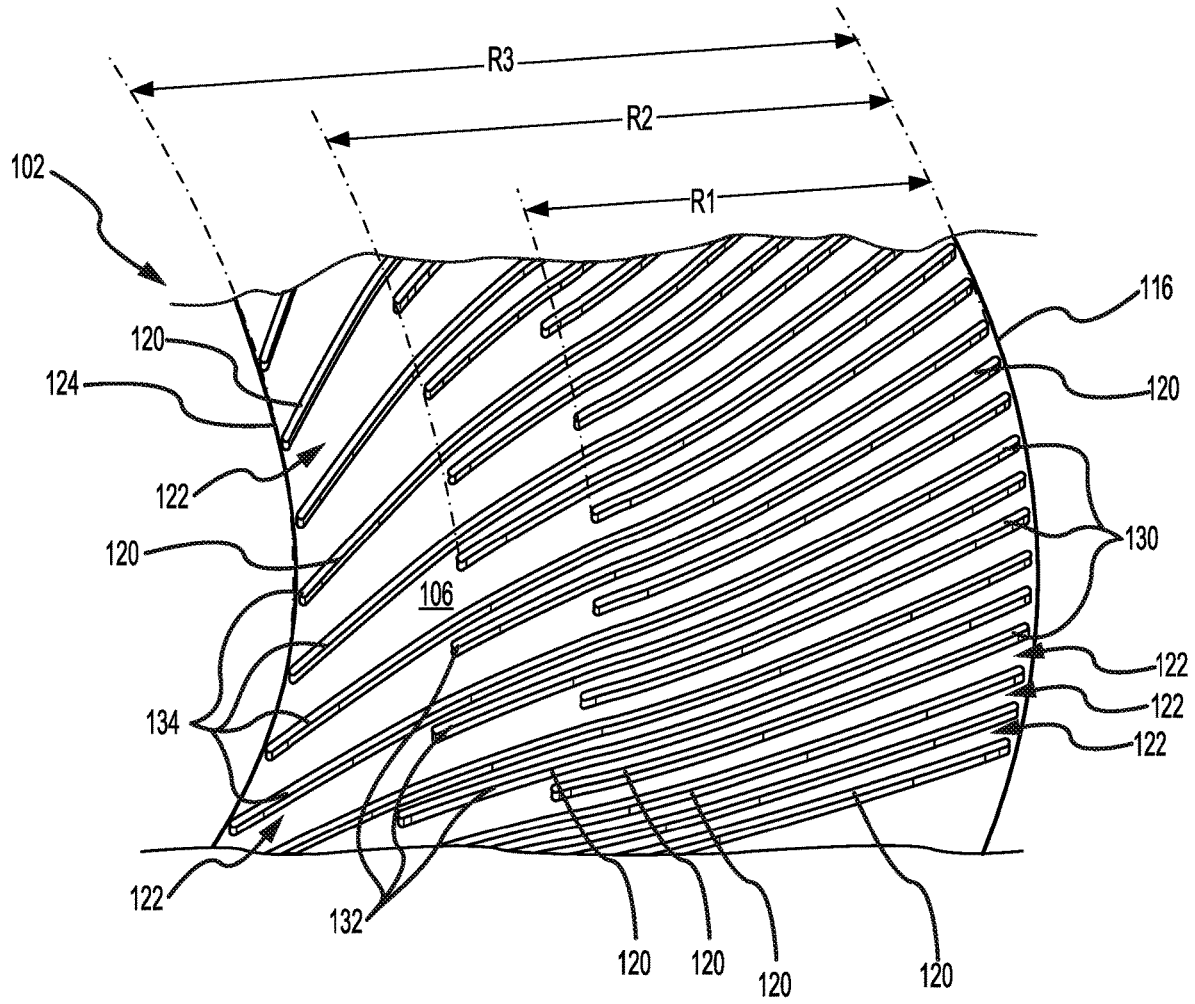
FIG. 3 illustrates a portion of a diffuser fins layer for a layered diffuser-channel heat exchanger, in accordance with various embodiments.

With reference to FIG. 3, a portion of a diffuser fins layer 102 is illustrated. Diffuser fins 120 are formed over topside surface 106 and extending radially inward from outer circumference 116. The locations of diffuser fins 120 may be selected to form approximately equal pressure drops in each of the airflow channels 122 formed between circumferentially adjacent diffuser fins 120.

An orientation, a length, a density, and/or a number of the diffuser fins 120 may be tailored across the topside surface 106 of fluid channel layer 104 in order to control the heat flux profile and/or to be compatible with the manufacturing method. In various embodiments, diffuser fins 120 are angled to match a circumferential flow direction of the fluid entering the airflow channels 122 at inner circumference 124. Stated differently, the angle of diffuser fins 120 relative to a line tangent to inner circumference 124 is approximately, equal to the angle of the flow direction of the fluid entering the channel, relative to the same tangent line. Stated yet another way, diffuser fins 120 are approximate parallel to the flow direction of fluid as it enters the airflow channel 122 defined by the diffuser fins 120. As used in the previous context only, "approximately parallel" means±10° from parallel.

Due to the inner circumference 124 being less than the outer circumference, the diffuser fins 120 may become closer together in a radially inward direction. In this regard, a radial length of diffuser fins 120 may be varied across the diffuser fins layer 102. In various embodiments, a first group 130 of diffuser fins 120 may have a first radial length L1, a second group 132 of diffuser fins 120 may have a second radial length L2, which is greater than radial length L1, and a third group 134 of diffuser fins 120 may have a third radial length L3, which is greater than radial length L2. The first group 130, second group 132, and third group 134 may all extend radially inward from outer circumference 116 (i.e., they may extend towards inner circumference 124). In various embodiments, the third group 134 may extend from outer circumference 116 to inner circumference 124. While diffuser fins layer 102 is illustrated as having diffuser fins 120 of three (3) different length (e.g., first radial length R1, second radial length R2, and third radial length R3), it is contemplated and understood that diffuser fins layer 102 may any number of diffuser fin lengths depending on the desired pressure drop between inner circumference 124 and outer circumference 116.

Returning to FIGS. 1A and 1B, a blower 140 may be located in a central cavity 142 of layered diffuser-channel heat exchanger 100. Central cavity 142 is surrounded and/or bounded by the fluid channel layers 104 and the diffuser fins layers 102. Blower 140 may include one or stage of rotating blades 144. Blades 144 are configured to rotate about an axis A. As used herein, the terms "radial" and "radially" refer to directions perpendicular axis A, the terms "circumferential" and "circumferentially" refer to directions about axis A, and the terms "axial" and "axially" refer to directions parallel to axis A.

Blower 140 may include a motor 150 configured to drive rotation of the blades 144. Rotation of blades 144 is configured to draw an airflow 156 into an inlet 152 of layered diffuser-channel heat exchanger 100. Inlet 152 may be formed by blower 140. In various embodiments, a cover plate 158 may be formed over the topmost diffuser fins layer 102. Cover plate 158 has been removed from FIG. 1A to illustrate details of the topmost diffuser fins layer 102. In various embodiments, motor 150 may be located on an axially opposite end of layered diffuser-channel heat exchanger 100 relative to inlet 152.

In accordance with various embodiments, a first stage 160 of blades 144 may direct a first portion 1561 of airflow 156 between topside surface 106*d* of fourth fluid channel layer 104*d* and cover plate 158. Airflow portion 1561 flows radially outward through the airflow channels 122 (FIG. 3) formed between circumferentially adjacent diffuser fins 120*d*. A second stage 162 of blades 144 may direct a second portion 1562 of airflow 156 between topside surface 106*c* of third fluid channel layer 104*c* and underside surface 108*d* of fourth fluid channel layer 104*d*. Airflow portion 1562 flows radially outward through the airflow channels 122 (FIG. 3) formed between circumferentially adjacent diffuser fins 120*c*. A third stage 164 of blades 144 may direct at third portion 1563 of airflow 156 between topside surface 106*b* of second fluid channel layer 104*b* and underside surface 108*c* of third fluid channel layer 104*c*. Airflow portion 1563 flows radially outward through the airflow channels 122 (FIG. 3) formed between circumferentially adjacent diffuser fins 120*b*. A fourth stage 166 of blades 144 may direct a fourth portion 1564 of airflow 156 between topside surface 106*a* of first fluid channel layer 104*a* and underside surface 108*b* of second fluid channel layer 104*b*. Airflow portion 1564 flows radially outward through the airflow channels 122 (FIG. 3) formed between circumferentially adjacent diffuser fins 120*a*. While blower 140 is illustrated as having four (4) stages of blades 144 (i.e., four coaxial fans), it is contemplated and understood that blower 140 may include any number of blade stages. In various embodiments, the number of blade stages may be equal to the number of diffuser fins layers 102.

In accordance with various embodiments, the shape of airflow channels 122 tends to allow pressure losses to be recovered on the air side of layered diffuser-channel heat exchanger 100. Blower 140 directs air flow through airflow channels 122. As compared to heat exchanger systems having external fans, locating blower 140 in central cavity 142 tends to provide for greater heat transfer coefficients at the same fan power. In various embodiments, layered diffuser-channel heat exchanger 100 may be operated at lower fan power to achieve the same heat transfer coefficient as compared to an external fan systems. Locating blower 140 in central cavity 142 also reduces a size footprint of the heat exchanger (e.g., reduces the combined size of the heat exchanger and blower as compared to a traditional heat exchanger having a traditional fan or blower located exterior to the heat exchanger).

Figure 4:
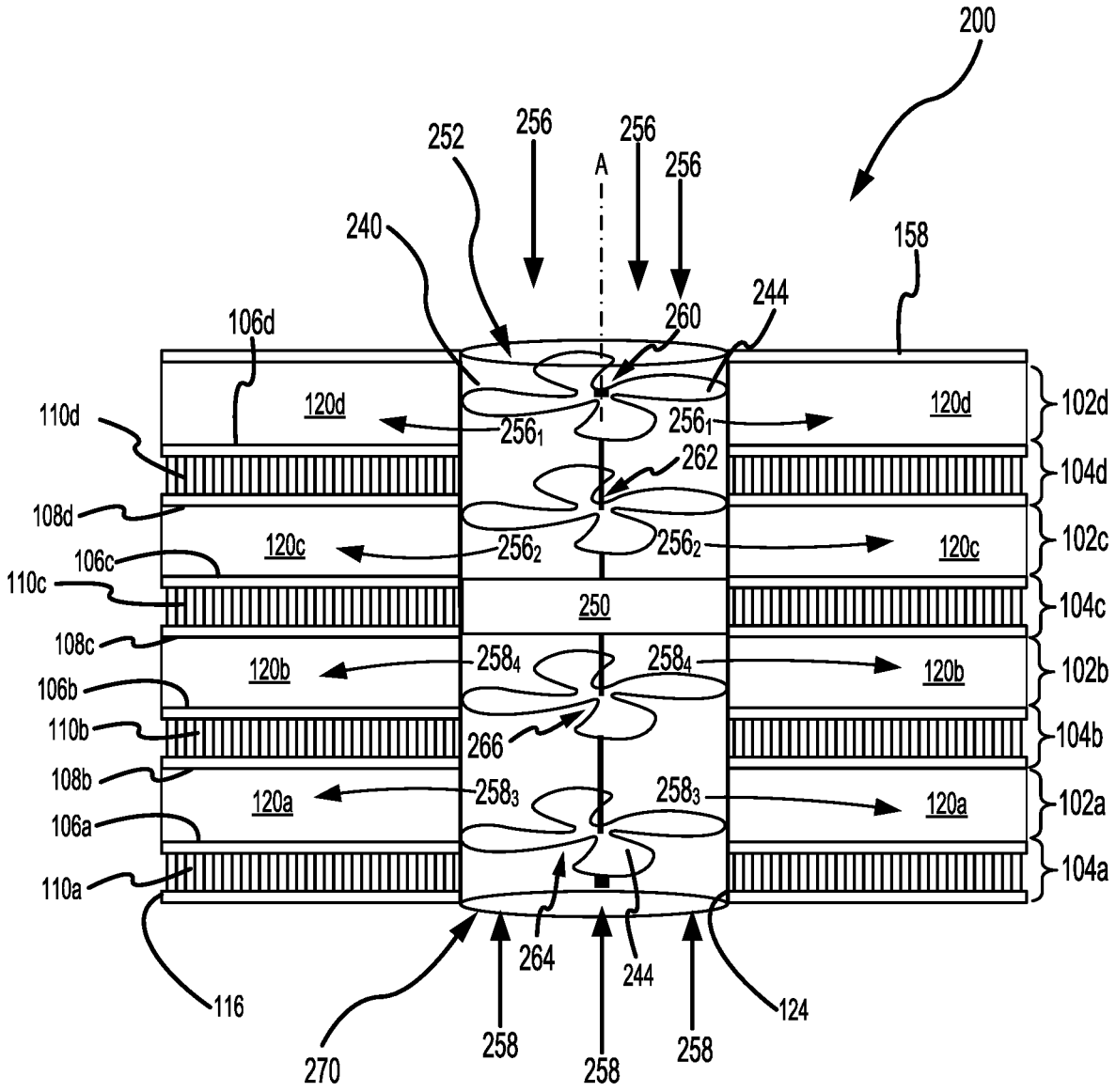
FIG. 4 illustrates a layered diffuser-channel heat exchanger having a central motor, in accordance with various embodiments.

Referring to FIG. 4, a layered diffuser-channel heat exchanger 200 including a blower 240 having a central motor 250 is illustrated. In various embodiments, layered diffuser-channel heat exchanger 100 in FIG. 1B, may include blower 240 in place of blower 140. In this regard, elements with like element numbering, as depicted in FIG. 1B, are intended to be the same and will not necessarily be repeated for the sake of brevity.

Blower 240 includes a motor 250 configured to drive rotation of a first stage 260 of the blades 244, a second stage 262 of the blades 244, a third stage 264 of the blades 244, and a fourth stage 266 of blades 244. Rotation of the first and second stages 260, 262 of blades 244 is configured to draw a first airflow 256 into a first airflow inlet 252 of layered diffuser-channel heat exchanger 200. First airflow inlet 252 may be formed at a first axial end of blower 240. Rotation of the third and fourth second stages 264, 266 of blades 244 is configured to draw a second airflow 258 into a second airflow inlet 270 of layered diffuser-channel heat exchanger 200. Second airflow inlet 270 may be formed at a second axial end of blower 240. In this regard, motor 250 is located axially between second stage 262 and fourth stage 266 of blades 244. While blower 240 is illustrated as having four stage of blades 144 with two stages of blades on opposing sides of motor 250, it is contemplated and understood that blower 240 may include any number of blade stages and that motor 250 may be located between any two of the blade stages.

In accordance with various embodiments, a first stage 260 of blades 244 may direct a first portion $\mathbf{256}_1$ of first airflow 256 between topside surface 106*d* of fourth fluid channel layer 104*d* and cover plate 158. Airflow portion $\mathbf{256}_1$ flows radially outward through the airflow channels 122 (FIG. 3) formed between circumferentially adjacent diffuser fins 120*d*. Second stage 262 of blades 244 may direct a second portion 2562 of first airflow 256 between topside surface 106*c* of third fluid channel layer 104*c* and underside surface 108*d* of fourth fluid channel layer 104*d*. Airflow portion 2562 flows radially outward through the airflow channels 122 (FIG. 3) formed between circumferentially adjacent diffuser fins 120*c*. Third stage 264 of blades 244 may direct a first portion $\mathbf{258}_1$ of second airflow 258 between topside surface 106*a* of first fluid channel layer 104*a* and underside surface 108*b* of second fluid channel layer 104*b*. Airflow portion $\mathbf{258}_1$ flows radially outward through the airflow channels 122 (FIG. 3) formed between circumferentially adjacent diffuser fins 120*a*. Fourth stage 266 of blades 244 may direct a second portion 2582 of second airflow 258 between topside surface 106*b* of first fluid channel layer 104*a* and underside surface 108*c* of third fluid channel layer 104*c*. Airflow portion 2582 flows radially outward through the airflow channels 122 (FIG. 3) formed between circumferentially adjacent diffuser fins 120*b*.

Figure 5:
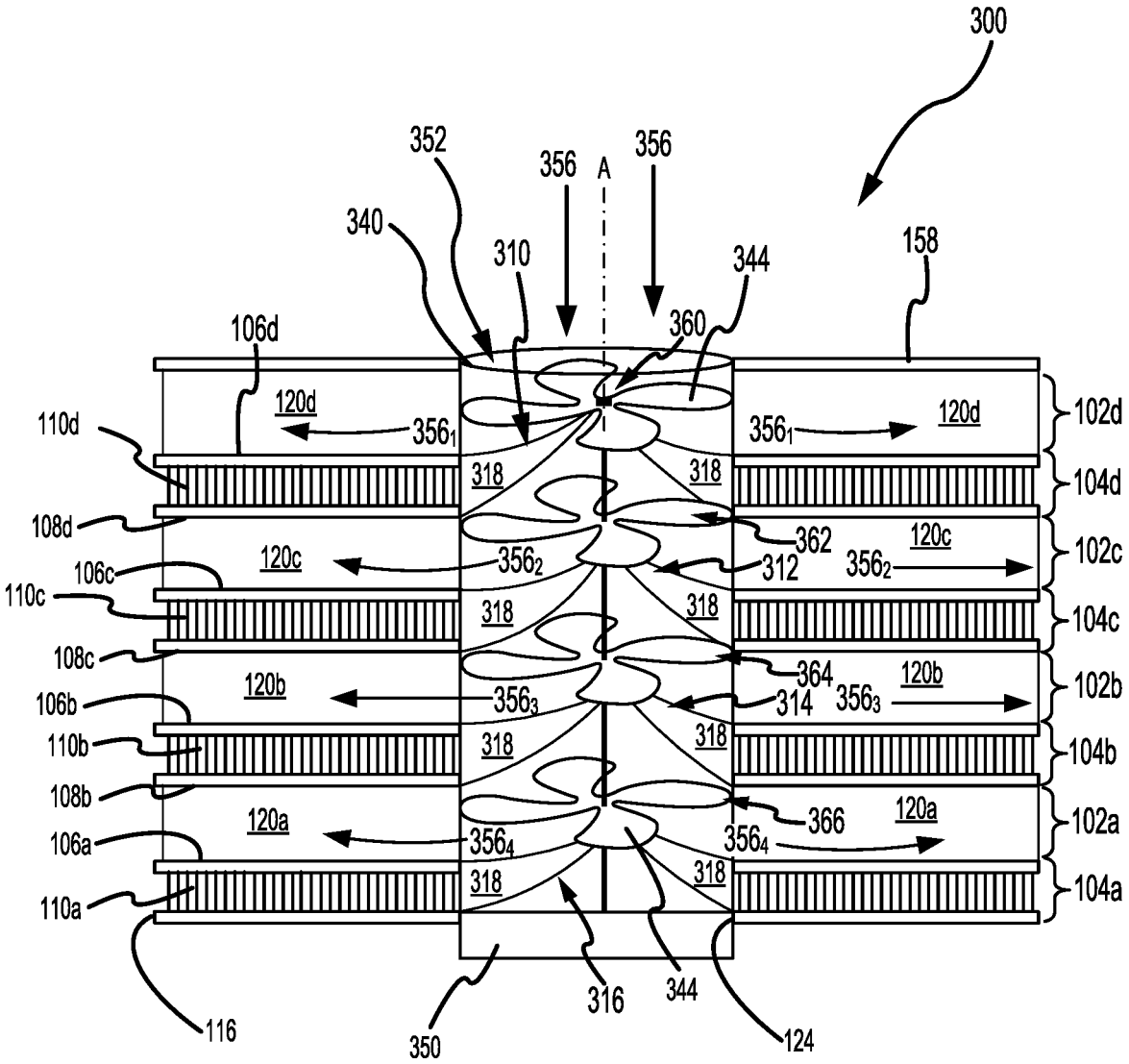
FIG. 5 illustrates a cross-section view of a layered diffuser-channel heat exchanger having vane stages between the cooling channel layers, in accordance with various embodiments.

With reference to FIG. 5, a layered diffuser-channel heat exchanger 300 including a blower 340 having vane stages 310, 312, 314, 316 interleaved with a first stage 360, a second stage 362, a third stage 364, and a fourth stage 366 of rotating blades 344 is illustrated. In various embodiments, layered diffuser-channel heat exchanger 100 in FIG. 1B, may include blower 340 in place of blower 140. In this regard, elements with like element numbering, as depicted in FIG. 1B, are intended to be the same and will not necessarily be repeated for the sake of brevity.

Blower 340 includes one or more vane stages, such as first vane stage 310, second vane stage 312, third vane stage 314, and fourth vane stage 316, of non-rotating vanes 318. Blower 340 includes a motor 350 configured to drive rotation of first stage 360, second stage 362, third stage 364 and fourth stage 366 of rotating blades 344. Rotation of the of blades 344 is configured to draw an airflow 356 into an airflow inlet 352 of layered diffuser-channel heat exchanger 300. Airflow inlet 352 may be formed at a first axial end of blower 340. Motor 350 may be located at a second, opposite axial end of layered diffuser-channel heat exchanger 300. Vanes 318 are configured to direct the airflow 356 to the area between adjacent fluid channel layers 104. In this regard, vanes 318 direct the airflow 356 toward airflow channels 122 and diffuser fins 120.

In various embodiments, the vanes 318 of first vane stage 310 may be configured to direct a first portion 3561 of airflow 356 into fourth diffuser fins layer 102*d*. The vanes 318 of first vane stage 310 may also help direct a second portion 3562 of airflow 356 into third diffuser fins layer 102*c*. In this regard, the vanes 318 of first vane stage 310 may direct airflow 356 generally away from inner circumference 124 (FIG. 2A) of fourth fluid channel layer 104*d*.

The vanes 318 of second vane stage 312 may be configured to direct second portion 3562 of airflow 356 into third diffuser fins layer 102*c*. The vanes 318 of second vane stage 312 may also help direct a third portion 3563 of airflow 356 into second diffuser fins layer 102*b*. In this regard, the vanes 318 of second vane stage 312 may direct airflow 356 generally away from inner circumference 124 (FIG. 2A) of third fluid channel layer 104*c*.

The vanes 318 of third vane stage 314 may be configured to direct third portion 3563 of airflow 356 into second diffuser fins layer 102*b*. The vanes 318 of third vane stage 314 may also help direct a fourth portion 3564 of airflow 356 into first diffuser fins layer 102*a*. In this regard, the vanes 318 of third vane stage 314 may direct airflow 356 generally away from inner circumference 124 (FIG. 2A) of second fluid channel layer 104*b*.

The vanes 318 of fourth vane stage 316 may be configured to direct fourth portion 3564 of airflow 356 into first diffuser fins layer 102*a*. In this regard, the vanes 318 of fourth vane stage 316 may direct airflow 356 generally away from inner circumference 124 (FIG. 2A) of first fluid channel layer 104*a*. While layered diffuser-channel heat exchanger 300 is illustrated as having four (4) diffuser fins layers 102 and fluid channel layers 104, and blower 340 is illustrated with four (4) stages of vanes and four (4) stages of blades, it is contemplated and understood that layered diffuser-channel heat exchanger 300 may include any number of diffuser fins layers 102 and fluid channel layers 104, and blower 340 may include any number of stages of vanes and stages of blades. In various embodiments, the number of stages of vanes and/or the number of stages of blades may be equal to the number of diffuser fins layers 102. In various embodiments, blower 340 may include a central motor, similar to blower 240 and motor 250 in FIG. 4.

Figure 6:
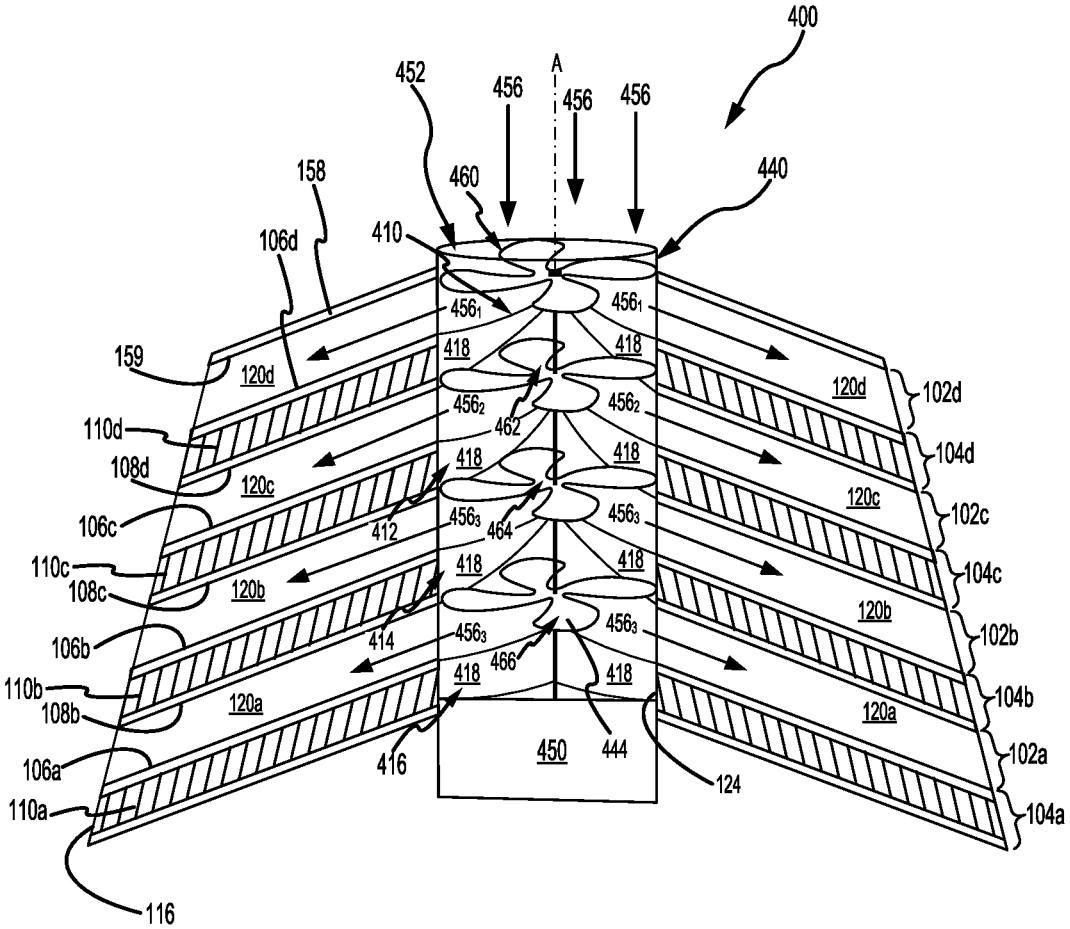
FIG. 6 illustrates a cross-section view of a layered diffuser-channel heat exchanger having angled diffuser fins and fluid channel layers, in accordance with various embodiments.

With reference to FIG. 6, a layered diffuser-channel heat exchanger 400 including angled diffuser fins layers 102 and fluid channel layers 104 is illustrated. Elements in FIG. 6 with like element numbering, as depicted in FIG. 1B, are intended to be the same and will not necessarily be repeated for the sake of brevity. In various embodiments, layered diffuser-channel heat exchanger 400 includes a blower 440 having first stage 410, second stage 412, a third stage 414, and a fourth stage 416 of non-rotating vanes 418 interleaved with a first stage 460, a second stage 462, a third stage 464, and a fourth stage 466 of rotating blades 444.

Blower 440 includes a motor 450 configured to drive rotation of first stage 460, second stage 462, third stage 464 and fourth stage 466 of rotating blades 444. Rotation of the of blades 444 is configured to draw an airflow 456 into an airflow inlet 452 of layered diffuser-channel heat exchanger 400. Airflow inlet 452 may be formed at a first axial end of blower 440. Motor 450 may be located at a second, opposite axial end of layered diffuser-channel heat exchanger 400. Vanes 418 are configured to direct the airflow 456 to the area between adjacent fluid channel layers 104. In this regard, vanes 418 direct the airflow 456 toward airflow channels 122 and diffuser fins 120.

In various embodiments, the vanes 418 of first vane stage 410 may be configured to direct a first portion $\mathbf{456}_1$ of airflow 456 into fourth diffuser fins layer 102*d*. The vanes 418 of second vane stage 412 may be configured to direct a second portion 4562 of airflow 456 into third diffuser fins layer 102*c*. The vanes 418 of third vane stage 414 may be configured to direct a third portion 4563 of airflow 456 into second diffuser fins layer 102*b*. The vanes t18 of fourth vane stage 416 may be configured to direct a fourth portion 4564 of airflow 456 into first diffuser fins layer 102*a*.

In accordance with various embodiments, diffuser fins layers 102 and fluid channel layers 104 are configured to be approximately parallel to flow direction of the airflow 456 as it exits vanes 418. For example, topside surface 106*d* of fourth fluid channel layer 104*d* may be approximately parallel to the direction of first airflow portion $\mathbf{456}_1$ as first airflow portion $\mathbf{456}_1$ exits vanes 418 of first vane stage 410. In this regard, the angle of diffuser fins layers 102 and fluid channel layers 104 may be configured to decrease, or minimize, the directional changes in airflow 456 as it enters airflow channels 122 (FIG. 3). For example, the angle of topside surface 106*d*, relative to axis A, may be approximately equal to the angle of the flow direction of the first airflow portion $\mathbf{456}_1$, relative to axis A. In various embodiments, topside surface 106*d* is not perpendicular to axis A. For example, the angle of topside surface 106*d*, relative to axis A, may be between 100° and 160°, between 105° and 150°, between 110° and 135°, or any other desired angle. The underside surface 159 of cover plate 158 may be approximately parallel to topside surface 106*d*. In various embodiments, first vane stage 410 may be eliminated and the orientation of topside surface 106*d* may be approximately parallel to the direction of the first airflow portion $\mathbf{456}_1$ exiting first blade stage 460. As used in the previous paragraph, "approximately parallel" means±5° from parallel and "approximately equal" means±5°.

In various embodiments, topside surface 106*c* of third fluid channel layer 104*c* may be approximately parallel the flow to direction of second airflow portion 4562 as it exits vanes 418 of second vane stage 412. For example, the angle of topside surface 106*c*, relative to axis A, may be approximately equal to the angle of the flow direction of the second airflow portion 4562, relative to axis A. In various embodiments, topside surface 106*c* is not perpendicular to axis A. For example, the angle of topside surface 106*c*, relative to axis A, may be between 100° and 160°, between 105° and 150°, between 110° and 135°, or any other desired angle. The underside surface 108*d* of fourth fluid channel layer 104*d* may be approximately parallel to topside surface 106*c*. In various embodiments, second vane stage 412 may be eliminated and the orientation of topside surface 106*c* may be approximately parallel to the direction of the second airflow portion 4562 exiting second blade stage 462. As used in the previous paragraph, "approximately parallel" means±5° from parallel and "approximately equal" means±5°.

In various embodiments, topside surface 106*b* of second fluid channel layer 104*b* may be approximately parallel the flow to direction of third airflow portion 4563 as third airflow portion 4563 exits vanes 418 of third vane stage 414. For example, the angle of topside surface 106*b*, relative to axis A, may be approximately equal to the angle of the flow direction of the third airflow portion 4563, relative to axis A. In various embodiments, topside surface 106*b* is not perpendicular to axis A. For example, the angle of topside surface 106*b*, relative to axis A, may be between 100° and 160°, between 105° and 150°, between 110° and 135°, or any other desired angle. The underside surface 108*c* of third fluid channel layer 104*c* may be approximately parallel to topside surface 106*b*. In various embodiments, third vane stage 414 may be eliminated and the orientation of topside surface 106*b* may be approximately parallel to the direction of the third airflow portion 4563 exiting third blade stage 464. As used in the previous paragraph, "approximately parallel" means±5° from parallel and "approximately equal" means±5°.

In various embodiments, topside surface 106*a* of first fluid channel layer 104*a* may be approximately parallel the flow to direction of fourth airflow portion 4564 as it exits vanes 418 of fourth vane stage 416. For example, the angle of topside surface 106*a*, relative to axis A, may be approximately equal to the angle of the flow direction of the fourth airflow portion 4564, relative to axis A. In various embodiments, topside surface 106*a* is not perpendicular to axis A. For example, the angle of topside surface 106*a*, relative to axis A, may be between 100° and 160°, between 105° and 150°, between 110° and 135°, or any other desired angle. The underside surface 108*b* of second fluid channel layer 104*b* may be approximately parallel to topside surface 106*a*. In various embodiments, fourth vane stage 416 may be eliminated, as the orientation of topside surface 106*b* may be approximately parallel to the direction of the fourth airflow portion 4564 as it exits further blade stage 466. As used in the previous paragraph, "approximately parallel" means±5° from parallel and "approximately equal" means±5°.

While layered diffuser-channel heat exchanger 400 is illustrated as having four (4) diffuser fins layers 102 and fluid channel layers 104, and blower 440 is illustrated with four (4) stages of vanes and four (4) stages of blades, it is contemplated and understood that layered diffuser-channel heat exchanger 400 may include any number of diffuser fins layers 102 and fluid channel layers 104, and blower 440 may include any number of stages of vanes and/or stages of blades. In various embodiments, the number of stages of vanes and/or the number of stages of blades may be equal to the number of diffuser fins layers 102. In various embodiments, blower 440 may include a central motor, similar to blower 240 and motor 250 in FIG. 4.

Figure 7:
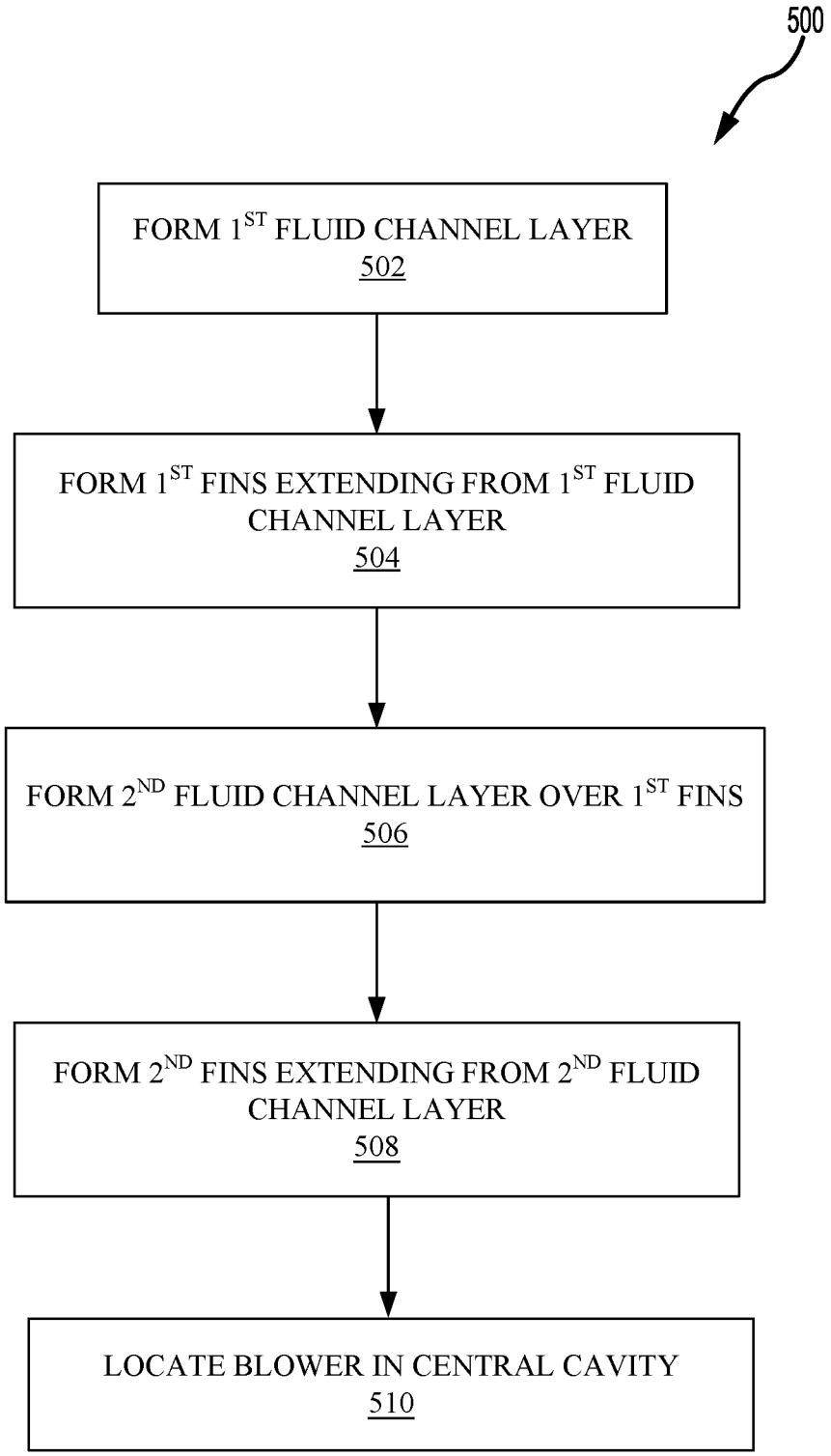
FIG. 7 illustrates a method of making a layered diffuser-channel heat exchanger, in accordance with various embodiments.

With reference to FIG. 7, a method 500 of making a layered diffuser-channel heat exchanger is also disclosed herein. In accordance with various embodiments, method 500 may comprise forming a first fluid channel layer having a first fluid channel located between a first surface and a second surface of the first fluid channel layer (step 502), forming a plurality of first diffuser fins extending from the first surface of the first fluid channel layer (step 504), and forming a second fluid channel layer over the plurality of first diffuser fins, with the second fluid channel layer having a second fluid channel located between a topside surface and a underside surface of the second fluid channel layer (step 506). Method 500 may further include forming a plurality of second diffuser fins extending from the topside surface of the second fluid channel layer (step 508).

In various embodiments, the method 500 may further comprise locating a blower in a central cavity surrounded by the first fluid channel layer, the plurality of first diffuser fins, and the second fluid channel layer (step 510). In various embodiments, the underside surface of the second fluid channel may be integrally formed with the plurality of first diffuser fins. In various embodiments, method 500 may comprise forming the first fluid channel layer, the plurality of first diffuser fins, and the second fluid channel layer using additive manufacturing.

In various embodiments, the method 500 may further comprise locating a first stage of stationary vanes axially between a first stage of blades of the blower and a second stage of blades of the blower. The first stage of stationary vanes may be configured to direct airflow between the first surface of a first fluid channel layer and the underside surface of a second fluid channel layer.

In various embodiments, the method 500 may further comprise orienting the first surface of the first fluid channel at a first non-perpendicular angle relative to an axis of rotation of first stage of blades of the blower, and orienting the topside surface of the second fluid channel at a second non-perpendicular angle relative to the axis of rotation of first stage of blades of the blower. The second non-perpendicular angle may be equal to or different from the first non-perpendicular angle.

In various embodiments, step 504 may comprise forming a first group of the first diffuser fins having a first radial length, forming a second group of the first diffuser fins having a second radial length greater than the first radial length, and forming a third group of diffuser fins having a third radial length greater the second radial length. Each of the first group of first diffuser fins, the second group of first diffuser fins, and the third group of first diffuser fins extends radially inward from an outer circumference of the first fluid channel layer.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Systems, methods, and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A layered diffuser-channel heat exchanger, comprising:

a plurality of fluid channel layers, each fluid channel layer of the plurality of fluid channel layers having a first surface, a second surface opposite the first surface, and a fluid channel located between the first surface and the second surface;

a plurality of diffuser fin layers interleaved with the plurality of fluid channel layers; and a blower located in a central cavity surrounded by the plurality of fluid channel layers and the plurality of diffuser fin layers.

2. The layered diffuser-channel heat exchanger of claim 1, wherein the blower includes:

a first stage of blades configured to rotate about an axis;

a second stage of blades configured to rotate about the axis; and a first stage of stationary vanes located axially between the first stage of blades and the second stage of blades, wherein the first stage of stationary vanes is configured to direct airflow between the first surface of a first fluid channel layer and the second surface of a second fluid channel layer, wherein the plurality of fluid channel layers includes the first fluid channel layer and the second fluid channel layer, and wherein the first fluid channel layer is axially adjacent to the second fluid channel layer.

3. The layered diffuser-channel heat exchanger of claim 2, wherein the blower further comprises:

a third stage of blades configured to rotate about the axis; and a second stage of stationary vanes located axially between the second stage of blades and the third stage of blades, wherein the second stage of stationary vanes is configured to direct airflow between the first surface of the second fluid channel layer and the second surface of a third fluid channel layer, wherein the plurality of fluid channel layers includes the third fluid channel layer.

4. The layered diffuser-channel heat exchanger of claim 3, further comprising a motor located axially between the third stage of blades and the second stage of blades.

5. The layered diffuser-channel heat exchanger of claim wherein the first surface of a first fluid channel layer of the plurality of fluid channel layers is oriented at a non-perpendicular angle relative to an axis of rotation of the blower.

6. The layered diffuser-channel heat exchanger of claim 1, wherein a first diffuser fin layer of the plurality of diffuser fin layers includes a plurality of diffuser fins integrally formed with the first surface of a first fluid channel layer and the second surface of a second fluid channel layer, wherein the plurality of fluid channel layers includes the first fluid channel layer and the second fluid channel layer.

7. The layered diffuser-channel heat exchanger of claim 6, wherein the plurality of diffuser fins includes a first group of diffuser fins having a first radial length, a second group of diffuser fins having a second radial length greater than the first radial length, and a third group of diffuser fins have a third radial length greater the second radial length, wherein each of the first group of diffuser fins, the second group of diffuser fins, and the third group of diffuser fins extends radially inward from an outer circumference of the first fluid channel layer, and wherein the third group of diffuser fins extends from the outer circumference of the first fluid channel layer to an inner circumference of the first fluid channel layer.

8. A method of making a layered diffuser-channel heat exchanger, comprising:

forming a first fluid channel layer having a first fluid channel located between a first surface and a second surface of the first fluid channel layer;

forming a plurality of first diffuser fins extending from the first surface of the first fluid channel layer;

forming a second fluid channel layer over the plurality of first diffuser fins, the second fluid channel layer having a second fluid channel located between a topside surface and an underside surface of the second fluid channel layer;

forming a plurality of second diffuser fins extending from the topside surface of the second fluid channel layer; and locating a blower in a central cavity surrounded by the first fluid channel layer, the plurality of first diffuser fins, the second fluid channel layer; and the plurality of second diffuser fins.

9. The method of claim 8, wherein the first fluid channel layer, the plurality of first diffuser fins, the second fluid channel layer, and the plurality of second diffuser fins are formed using additive manufacturing.

10. The method of claim 8, further comprising locating a first stage of stationary vanes axially between a first stage of blades of the blower and a second stage of blades of the blower, wherein the first stage of stationary vanes is configured to direct airflow between the first surface of the first fluid channel layer and the underside surface of the second fluid channel layer.

11. The method of claim 8, further comprising:

orienting the first surface of the first fluid channel at a first non-perpendicular angle relative to an axis of rotation of first stage of blades of the blower; and orienting the topside surface of the second fluid channel at a second non-perpendicular angle relative to the axis of rotation of first stage of blades of the blower.

12. The method of claim 8, wherein the underside surface of the second fluid channel layer is integrally formed with the plurality of first diffuser fins.

13. The method of claim 8, wherein forming the plurality of first diffuser fins comprises:

forming a first group of the plurality of first diffuser fins having a first radial length;

forming a second group of the plurality of first diffuser fins having a second radial length greater than the first radial length; and forming a third group of the plurality of first diffuser fins have a third radial length greater the second radial length, wherein each of the first group of the plurality of first diffuser fins, the second group of the plurality of first diffuser fins, and the third group of the plurality of first diffuser fins extends radially inward from an outer circumference of the first fluid channel layer.

14. The method of claim 8, further comprising locating a blower in a central cavity surrounded by the first fluid channel layer, the plurality of first diffuser fins, and the second fluid channel layer, wherein the blower comprises a motor configured to drive rotation of a first stage of blades and a second stage of blades, wherein the motor is located axially between the first stage of blades and the second stage of blades.

15. A layered diffuser-channel heat exchanger, comprising:

a first fluid channel layer having a first fluid channel located between a first surface and a second surface of the first fluid channel layer;

a plurality of first diffuser fins extending from the first surface of the first fluid channel layer, wherein the plurality of first diffuser fins is integrally formed with the first surface;

a plurality of second diffuser fins extending from the second surface of the first fluid channel layer, wherein the plurality of second diffuser fins is integrally formed with the second surface; and a blower located in a central cavity surrounded by the first fluid channel layer, the plurality of first diffuser fins, and the plurality of second diffuser fins.

16. The layered diffuser-channel heat exchanger of claim 15, wherein the first fluid channel is formed in a circumferential serpentine pattern.

17. The layered diffuser-channel heat exchanger of claim 16, further comprising a fluid source coupled to an inlet of first fluid channel, wherein the circumferential serpentine pattern causes fluid from the fluid source to flow circumferentially and radially inward across the first fluid channel layer.

18. The layered diffuser-channel heat exchanger of claim 15, further comprising a second fluid channel layer integrally formed with the plurality of first diffuser fins.

* * * * *